US009931694B2

(12) United States Patent
Yamauti et al.

(10) Patent No.: US 9,931,694 B2
(45) Date of Patent: Apr. 3, 2018

(54) CASTING NOZZLE FOR CONTINUOUS CASTING

(75) Inventors: Noriaki Yamauti, Ena (JP); Shigeaki Takahashi, Ena (JP); Shojiro Naitoh, Ena (JP)

(73) Assignee: Akechi Ceramics Co., Ltd., Ena (JP)

( * ) Notice: Subject to any disclaimer, the term of this patent is extended or adjusted under 35 U.S.C. 154(b) by 302 days.

(21) Appl. No.: 13/086,693

(22) Filed: Apr. 14, 2011

(65) Prior Publication Data

US 2011/0240248 A1 Oct. 6, 2011

Related U.S. Application Data

(63) Continuation of application No. PCT/JP2010/055679, filed on Mar. 30, 2010.

(51) Int. Cl.
*B22D 41/50* (2006.01)
*B22D 11/10* (2006.01)
*B22D 41/56* (2006.01)

(52) U.S. Cl.
CPC ..... *B22D 41/50* (2013.01); *B22D 11/10* (2013.01); *B22D 41/502* (2013.01); *B22D 41/56* (2013.01)

(58) Field of Classification Search
CPC ..... B22D 41/50
USPC ..... 164/437, 47, 488; 222/591, 590, 606; 118/400, 300, 410, DIG. 18
See application file for complete search history.

(56) References Cited

U.S. PATENT DOCUMENTS 4,669,528 A 6/1987 Szadkowski
4,792,070 A * 12/1988 Daussan et al. ..... 222/606
4,995,535 A * 2/1991 Ooya et al. ..... 222/607
5,866,022 A 2/1999 Hall
5,954,989 A * 9/1999 Brook et al. ..... 222/600
2001/0035438 A1 11/2001 Ando et al.
2003/0029892 A1 * 2/2003 Kawano et al. ..... 222/606
(Continued)

FOREIGN PATENT DOCUMENTS

CN 201201049 3/2009
EP 1590114 B1 3/2006
JP 62-200986 U 12/1987
(Continued)

OTHER PUBLICATIONS

English Machine Translation of Nakamura et al.*
(Continued)

*Primary Examiner* — Kevin P Kerns
*Assistant Examiner* — Steven S Ha
(74) *Attorney, Agent, or Firm* — Oblon, McClelland, Maier & Neustadt, L.L.P.

(57) ABSTRACT

A casting nozzle to be used in a nozzle exchange (insert and/or removal) device of nozzle in continuous casting which comprises the nozzle which constitutes a tubular part provided with a channel, a rectangular flange or plate having the channel for casting, wherein the plate has an upper surface and a rear surface having two arcs, which are provided with a radius R arranged on the both sides of the plate in the perpendicular direction of a nozzle insertion (hereafter called X direction) and a supporting faces on both sides of the nozzle in the direction of a nozzle insertion (hereafter called Y direction), and a metal case for reinforcing and covering the flange or plate and the upper part of the tubular part.

6 Claims, 2 Drawing Sheets

(56) References Cited

U.S. PATENT DOCUMENTS

| | | | |
|---|---|---|---|
| 2010/0242245 | A1 | 9/2010 | Yamamoto et al. |
| 2011/0204103 | A1 | 8/2011 | Tofuku et al. |

FOREIGN PATENT DOCUMENTS

| | | | | |
|---|---|---|---|---|
| JP | 11-84474 | A | | 3/1999 |
| JP | 2000-343208 | A | | 12/2000 |
| JP | 2001-314949 | A | | 11/2001 |
| JP | 2005-211905 | A | | 8/2005 |
| JP | 2005211905 | A | * | 8/2005 |
| JP | 2008-178899 | | | 8/2008 |
| JP | 2009-190085 | A | | 8/2009 |
| JP | 2009-255120 | | | 11/2009 |
| WO | 00/32337 | A1 | | 6/2000 |
| WO | 2009084654 | | | 9/2009 |

OTHER PUBLICATIONS

Notification of Reasons for Refusal for Japanese Patent Application No. 2010-530209, dated Apr. 3, 2012, with English translation.

Hideyuki Ikenotani, PCT Written Opinion of the International Searching Authority dated Mar. 30, 2010 (Japanese) from International Searching Authority.

Masashi Honda, PCT International Preliminary Report on Patentability (Chapter I of the Patent Cooperation Treaty) dated Oct. 23, 2012 From the International Bureau of WIPO.

The Extended European Search Report (EESR) for corresponding application No. PCT/JP2010/055679 dated Sep. 17, 2013, European Patent Office, Munich.

* cited by examiner

CASTING NOZZLE FOR CONTINUOUS CASTING

CROSS REFERENCE TO RELATED APPLICATION

This is a Continuation Application claiming priority under 35 U. S. C. § 120 of International Application No. PCT/JP2010/055679, filed on Mar. 30, 2010, the disclosure of which is incorporated herein by reference in its entirety.

FIELD OF INVENTION

The present invention is related to a casting nozzle for continuous casting feeding a molten metal from a metallurgical vessel to another metallurgical vessel. To be more specific the nozzle is used for feeding molten steel from tundish to casting mold or the nozzle feeding molten metal from ladle to tundish in continuous casting.

BACKGROUND OF INVENTION

A nozzle used for feeding from a vessel to another prevents chemical reactions between air and the metal and also prevents the heat loss by a radiation of the molten metal. Meanwhile the nozzle is abraded by a molten metal due to a thermal stress and hence a life of a nozzle limits the casting time in continuous casting. A conventional nozzle, insert and removal device (hereafter called nozzle exchange device) give a solution to overcome the limit of casting time of a nozzle), for example U.S. Pat. No. 4,669,528.

For example when the outer surface of a nozzle at the level of meniscus reaches a certain level or a breakage of the nozzle occurs, the casting is stopped and the eroded nozzle is exchanged for a new one in a short period and the casting continues. Normally the nozzle is made up of alumina-graphite and the nozzle comprises a flange or a plate (hereafter called flange or plate) connected to a cylinder hereunder and outlet holes on both sides of the cylinder.

More exactly speaking a nozzle is provided with a tubular channel and a flange plate with a casting hole. The plate is connected with the upper nozzle constituting a feeding channel of a molten metal to the nozzle. The plate is provided with the upper surface and the down surface, which is connected to supporting surfaces provided on the both side of nozzle holes.

The nozzle is able to slide between an upper nozzle feeding molten metal from a tundish, a bottom plate attached to the upper nozzle or a fixed plate attached with casting control device and a lower flat plate.

In this text a casting nozzle does not means an upper nozzle fixed to a tundish but a nozzle being able to slide in the nozzle exchange device.

PCT WO 00/32337 discloses a refractory nozzle provided with a shock absorbing intermediate region between a metal case and the refractory part of nozzle.

The region is filled up with a material which is solid in an ambient temperature and deformable at a high temperature. Hence the space functions to reduce a thermo-mechanical stress and micro-cracks, occurring at the beginning of casting operation.

The disclosed nozzle is a nozzle being able to slide in an exchange device and is supported by an upward stress.

The nozzle is provided with a tapered part which is supported by an upward thrust to fasten the nozzle with the upper nozzle.

The thrust is generated by a spring or a locker, whereby the nozzle is fastened with an upper refractory material or an upper nozzle.

A casting nozzle is made of a mono-block or of combination of a few refractory parts. The upper part of nozzle with a flange and an upper tubular part of nozzle can be protected by a metal case.

However a conjunction between a tubular part and a flange exhibits cracks and micro-cracks, which occur during the use of a nozzle due to thermal stress or thermo-mechanical stress. Such cracks might be caused by a force to maintain the nozzle within the device and by vibration caused by flow of molten metal through the nozzle.

Such cracks cause breakage of the nozzle. The throttling of nozzle induces a lower pressure which causes suction of air, whereby oxygen and nitrogen in the air are contaminated in the molten metal or molten steel.

Further the refractory is damaged and cracked in combination of oxygen and high temperature, which accelerates micro degradation and finally suspends a casting operation.

Some methods have been proposed to enhance a resistance of cracks of a nozzle. Some refractory are known, which have a superior resistance against cracks.

However, those materials are sensitive to erosion or corrosion. Such means and other improvement enhance the life of casting nozzle.

Yet, there remains still the some problems to be solved.

Conventional nozzle exchange device causes a bending stress at the neck between the upper flange or plate and a tubular part, which induces cracks at the neck. And the plate is apt to deform along the axis parallel with the guided direction of plate.

Hence, E P 1590114 B1 (Japanese publication No. 2006-515803) discloses a casting nozzle (1), as disclosed in FIG. 1, having a flange or a plate (hereafter called plate), and a rear side having two inclined surface (3, 5) with different angles, which may prevent cracks.

The example is not protected with a metal case against the upward force on the metal case. The plate is, as is disclosed in FIG. 2, supported by springs exerting an upward force on an inclined surface (5).

In addition an upper casting nozzle (7) is fixed by a fixing plate (8).

The above solution intends to prevent the bending stress or to lessen the bending stress, which is contributed by a design of nozzle or an assembling process. However, cracks (10, 11, 12) are apt to occur in operation as shown in FIG. 3. The reason is suspected to be forces induced and directed to upward or horizontal direction due to a small thrust plate (9).

Therefore a frequent breakage of a casting nozzle occurs and the casting is suspended. Hence a more stable casting operation is intended by improvement of nozzle life, which leads to a new type of nozzle design.

PRIOR ART

[Reference 1] U.S. Pat. No. 4,669,528

[Reference 2] PCT WO 00/32337

[Reference 3] EP 1590114 B 1 (PCT patent published in Japan No. 2006-515803)

SUMMARY OF INVENTION

Object of Invention to be Solved

The present invention is to develop a nozzle design which causes dispersion of the force or stress which is caused during the use of a nozzle and the maintenance of nozzle in the nozzle exchange device, which inserts and/or removes a casting nozzle in the device.

Means to Solve the Object

The present invention discloses a casting nozzle (1) to be used in a nozzle exchange device, namely a nozzle insert and/or removal device of nozzle, in continuous casting which comprises: the nozzle constitutes a tubular part (21) provided with a channel (20);

a rectangular plate (22) having the channel for casting, wherein the plate has an upper surface and a lower surface having two convex arc portions (27), which are provided with a radius R arranged on the both sides of the plate in the direction of a nozzle insertion (hereafter called Y direction) and two plane surfaces on both sides of the nozzle in the perpendicular direction of a nozzle insertion (hereafter called X direction), and;

a metal case (23) for reinforcing and covering the plate (22) and the upper portion of the tubular part.

Further, a casting nozzle is encased in a metal case which is provided with a protrusion (24), which fills spaces between an insertion guide (25) and the metal case (23) itself.

Advantage of Invention

1) The nozzle has a great resistance to be cracked around the neck of a flange or plate of the nozzle because the upward thrust force of the plate 26 exerts on the arc portion 27 of the nozzle whereby the thrust force disperses to different directions.

2) Therefore a life of a nozzle is prolonged whereby a casing nozzle is used for a longer casting time and the productivity is enhanced.

3) Further casting speed of the casting operation or the suspension of casting operation during the exchange of the nozzle deteriorates the surface quality of the cast, which necessitates scarfing of cast products, which bring forth a loss of yield.

The present invention has the above advantages etc.

EMBODIMENT OF THE PRESENT INVENTION

With drawings or figures the present invention is now explained in detail but the invention is not restricted by the presented embodiment.

As disclosed in the recited references the invented casting nozzle is made of alumina-graphite (for example, alumina 65 wt %, graphite 29 wt %) and a flange or a plate of the nozzle is, for example, about 200 mm square and 40 mm thick.

The total length is about 1000 mm and the channel is about 80 mm in diameter and the outer diameter of nozzle is about 150 mm. And at the lower end of nozzle is provided with two bifurcated exits which feed molten metal to the side of a mold.

This bifurcated nozzle is mainly used kind to cast molten steel into a mold, for example, having a cross section of 200 mm×1200-2000 mm wide slab.

200 ton of molten steel can be cast into two strands in about 1 hour.

Preferably, one cycle of a casting operation (6 hours for example) can be continued with a single nozzle. Hence break and erosion of a nozzle should be avoided.

The size of nozzle, mold and casting time are recited as for example. But they are variable depending of operation practice.

Figure 1:
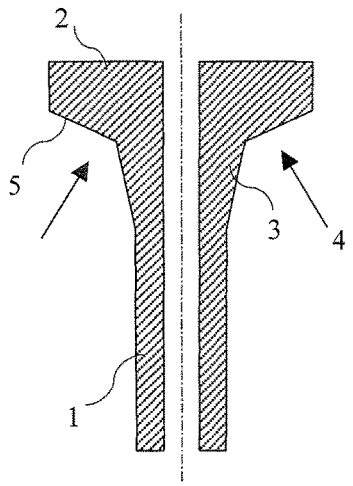
FIG. 1 shows a sectional view of a conventional casting nozzle.
Figure 2:
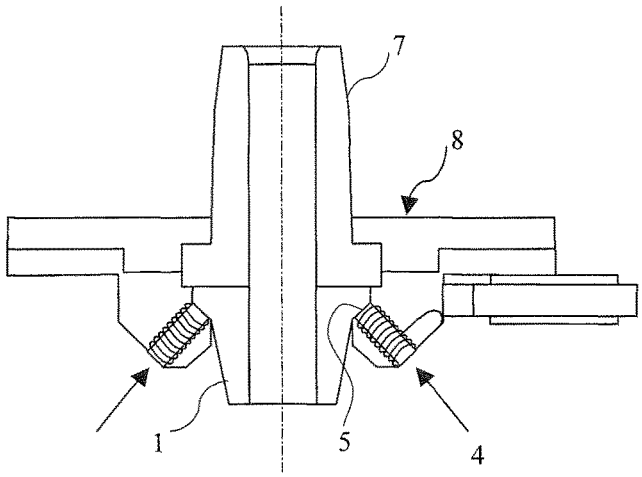
FIG. 2 explains a support method of a conventional nozzle, either by spring or locker.
Figure 3:
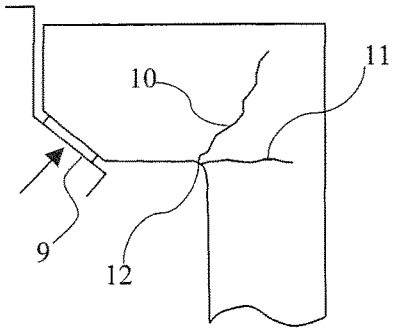
FIG. 3 indicates where cracks happen around the flange or the plate of nozzle.
Figure 4:
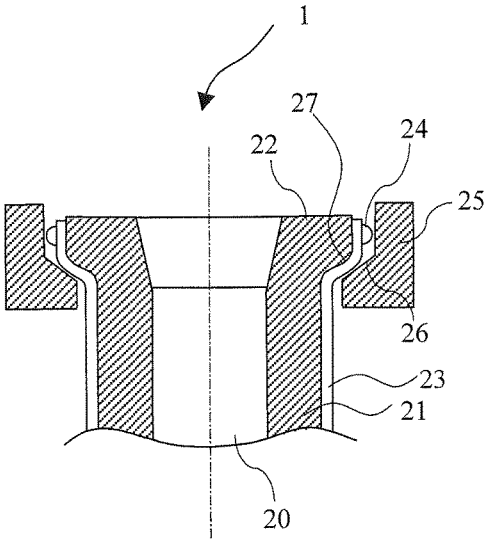
FIG. 4 shows a sectional view of an embodiment of the present invention in X direction.
Figure 5:
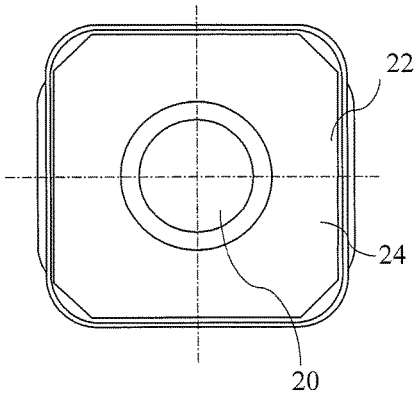
FIG. 5 is a plain view of the present invention from the top.

An example of present invention is presented in FIG. 4 to FIG. 7. FIG. 4 shows a cross section of a nozzle in a direction of mold thickness (hereafter called X direction). Molten metal flows into channel 20. The nozzle 1 can be inserted and removed in a nozzle exchange device.

The nozzle comprises a square flange or plate (22) having a channel (20) and a tubular part 21 having a channel.

Figure 6:
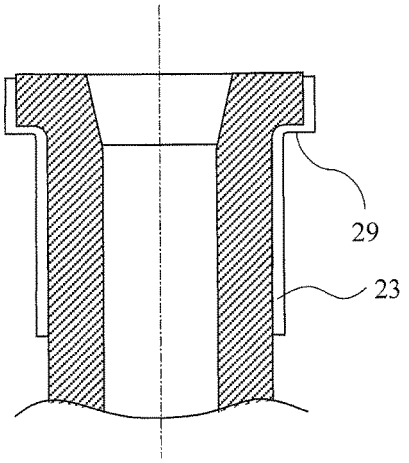
FIG. 6 is a sectional view of the present invention in Y direction.

The flange 22 is provided with an upper surface contacting an upper part in the upstream and a lower surface connecting to the upper part of tubular part. The lower surface has two arc portions 27 on both sides of Y direction and two flat plane portions 29 on front and rear sides of nozzle insert and removal direction (hereafter called Y direction) as shown in FIG. 6.

A metal case 23 for reinforcement of nozzle neck, made of steel for example, covers the flange 22 and the upper part of the tubular part 21.

The nozzle is preferably protected by a metal case 23 with a rigidity and further is preferably provided with protrusions 24. The protrusions 24 work to fill the space between the nozzle 1 and a guide 25 when the nozzle 1 is pushed into the guide 25 as shown in FIG. 4.

The protrusion 24 is preferable provided when the metal case is fabricated. The provision of the protrusion is preferably not by welding due to deformation after welding.

The thickness of protrusion 24 in horizontal direction is 6 to 7 mm at maximum and the thickness is 0 mm at the tip and the end of the protrusion in Y direction whereby a nozzle can be smoothly inserted into the supporting guide 25.

Figure 7:
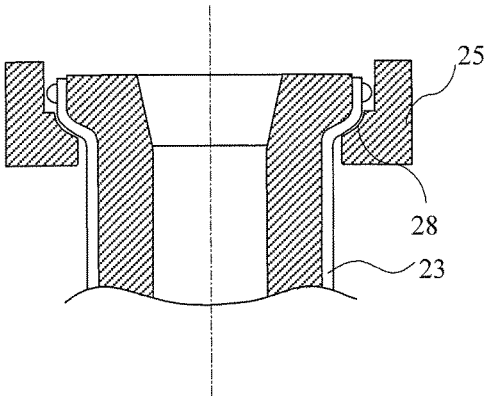
FIG. 7 shows a sectional view of a nozzle invented in X direction and another embodiment how the arc portions of a nozzle is supported by a guide having an arc support.

The radius of the arc portion 27 of the nozzle 1 is 15 to 30 mm and 20 mm is preferable. The arc portion 27 is supported by a guide 25 having an inclined surface 26 to the vertical direction. In an another embodiment a concave arc 28 having a larger radius than the R can support the arc portion of the nozzle as shown in FIG. 7.

With a conventional nozzle a nozzle can cast 4 hours in average (four charges of 200 ton molten steel). The present nozzle can cast 6 hours (6 charges). It means the cost of nozzle not only reduced but casting hourly efficiency is increased by 50%.

What is claimed is:

1. A casting nozzle structure, comprising:

a tubular part provided with a casting channel for casting molten metal from a tundish;

a flange part, provided on an upper portion of the tubular part, having a rectangular upper surface portion, two opposite side plane portions connected to the rectangular upper surface portion, each one of the two opposite side plane portions being positioned in parallel to a horizontal direction in which the nozzle is inserted, and an arc portion of radius R joining each of the two opposite side plane portions with the upper portion of the tubular part in an X direction;

a metal case for reinforcing and covering the side plane portions, the arc portion, and the upper portion of the tubular part; and an insert guide extending in a Y direction perpendicular to the X direction in parallel to each of the two opposite side plane portions of the flange part and having an inclined plane with respect to a vertical direction supporting the nozzle, for supporting the arc portion of the flange part via the metal case, wherein the nozzle is inserted into the insert guide only in the Y direction, and the radius R is equal to or greater than 15 mm.

2. The casting nozzle structure of claim 1, wherein the metal case is provided with a protrusion for enabling a contact with a vertical side plane portion of the insert guide connected to the inclined plane when the nozzle is inserted.

3. The casting nozzle structure of claim 2, wherein a cross section in a central portion of the protrusion has a hemispherical shape having a height of a horizontal gap between the metal case and the vertical side plane portion of the insert guide.

4. The casting nozzle structure of claim 1, wherein the metal case covering the arc portion has a quadrant arc shape of a radius R extending from a lower portion of each of the side plane portions to the upper portion of the tubular part.

5. The casting nozzle structure of claim 1, wherein the inclined plane has a concave arc portion having a larger radius than the radius R for accepting the arc portion.

6. The casting nozzle structure of claim 1, wherein the radius R is from 15 to 30 mm.

* * * * *